US006113440A

United States Patent [19]

Fijten et al.

[11] Patent Number: 6,113,440

[45] Date of Patent: Sep. 5, 2000

[54] ARRANGEMENT FOR RESILIENT CONTACTING

[75] Inventors: Roger Johannes Jacobus Fijten, Heeze; Petrus Richardus Martinus Van Dijk, Hertogenbosch, both of Netherlands

[73] Assignee: The Whitaker Corporation, Wilmington, Del.

[21] Appl. No.: 09/208,450

[22] Filed: Dec. 10, 1998

[30] Foreign Application Priority Data

Dec. 22, 1997 [DE] Germany ..... 97122612

[51] Int. Cl.[7] ..... H01R 4/48

[52] U.S. Cl. ..... 439/862

[58] Field of Search ..... 439/862, 637, 439/636, 66

[56] References Cited

U.S. PATENT DOCUMENTS

| | | | |
|---|---|---|---|
| 3,231,848 | 1/1966 | Ruehlemann | 439/637 |
| 4,087,151 | 5/1978 | Robert et al. | 339/176 MP |
| 5,354,216 | 10/1994 | Cruise et al. | 439/553 |
| 5,378,160 | 1/1995 | Yumibe et al. | 439/66 |

FOREIGN PATENT DOCUMENTS

| | | | |
|---|---|---|---|
| 0 373 003 | 6/1990 | European Pat. Off. | H01R 23/72 |
| 0590 517 | 4/1994 | European Pat. Off. | H01R 13/24 |
| 0 765 004 | 3/1997 | European Pat. Off. | H01R 13/24 |
| WO 95/17774 | 6/1995 | WIPO | H01R 9/09 |
| WO 97/45900 | 12/1997 | WIPO | H01R 23/72 |

OTHER PUBLICATIONS

European Search Report.

Patent Abstract of Japan, Matsushita Electric Ind., "Electronic Equipment Connecting Device", Jan. 1994.

*Primary Examiner*—Lincoln Donovan
*Assistant Examiner*—Javaid Nasri

[57] ABSTRACT

Connector for contacting contact faces of an electrical or electronic component, in particular a rechargeable battery, having a housing, in which is arranged, a resilient contact to be fastened on a connection side to a printed-circuit board, and, a contacting region to contact the contact face where to increase contacting flexibility and reliability, the resilient contact element has, in the contacting region, two convexities which are located at a distance from one another.

7 Claims, 6 Drawing Sheets

ARRANGEMENT FOR RESILIENT CONTACTING

BACKGROUND OF THE INVENTION

1 Field of the Invention

The invention relates to an electrical connector that is particularly sorted for the resilient contacting of contact faces of a battery 2 Description of the Prior Art Portable electrical or electronic appliances normally use a rechargeable battery as a power source. The battery has contact faces which, when inserted in the electronic or electrical appliance, are contacted by a contact incorporating resilient contact elements.

WO97/45900 discloses a connector for rechargeable batteries. The connector consists of an insulating contact-receiving housing, in which resilient contacts are arranged. The resilient contacts make the connection between a printed-circuit board and the contact faces of the rechargeable battery. The contacting region of the contact element that is touching the contact face is connected via a spring region to the connection region which is for connection to the printed-circuit board. The contacting region has a convex surface for contacting the contact faces of the rechargeable battery.

Since it is desirable for portable appliances that overall dimensions and weight be minimized, the connector must be designed to be as small and compact as possible. The spring force of the contacts must be high and must be maintained for the entire lifetime of the connector. Furthermore, in order to prevent wear and damage to the contacting region of the contact, as the battery will be repeatedly removed and reinserted, the contact pressure must be kept as low as possible. Higher flexibility of the contact may entail a greater degree of sensitivity to vibrations. In automotive applications, vibrations cannot be ruled out. In the case of sensitive electronic appliances, such as, for example, portable telephones, vibrations often result in brief interruptions in the power supply, this is undesirable for the functioning of the electronic components.

SUMMARY OF THE INVENTION

Proceeding from here, the object of the invention is to specify a connector for contacting of contact faces of an electrical or electronic component, such as a rechargeable battery, that is as insensitive to vibrations.

This object is achieved by means of a connector for contacting contact faces of a battery, the connector having the following features: an insulating contact-receiving housing with at least one passage for receiving a contact element, the contact element has at least one contacting region which serves for contacting the contact face of the battery, at least one connection region which serves for connection to a printed-circuit board, and a spring region which connects the connection region resiliently to the contacting region, the contacting region having at least two convexities, and the convexities are arranged so as to run adjacent one another in the longitudinal direction of the contact element.

It is advantageous that the connector ensures good contact in spite of vibrations. This is achieved in that a gap running in the longitudinal direction of the contact element is formed between the two convexities formed next to one another. This is also achieved when the contact element has a closed face between the two convexities arranged next to one another.

It is also advantageous that the connector ensures good contact in the case of vibrations in the range of the resonant frequencies of the contact element. This is achieved through the convexities that are arranged at such a distance from the center line of the contact element that the contact element is divided into part regions of different width.

It is advantageous, furthermore, that the connector can be produced from little material and is a compact. This is achieved since the spring region is designed to be comparatively wider in the region adjoining the connection region than in the region adjoining the contacting region.

The vibrational behavior of a relatively long, freely resilient contact element, which is fastened on one side on the connection side and is produced in regions with prestress, plays an important role in stable contacting. By means of a suitable design of the contact element and, above all, by the contacting region having a cross-section which takes the vibrational behavior into account, reliable contact function, even in the event of vibration can be achieved. The resonant frequency of the contact element is to be higher than the frequency of the vibrations acting on the contact element from outside. The position and design of the convexities and the position and design of the region between the convexities, with or without a gap, determine the resonant frequencies of the resilient contact element.

DETAILED DESCRIPTION OF THE PREFERRED EMBODIMENT

Figure 1:
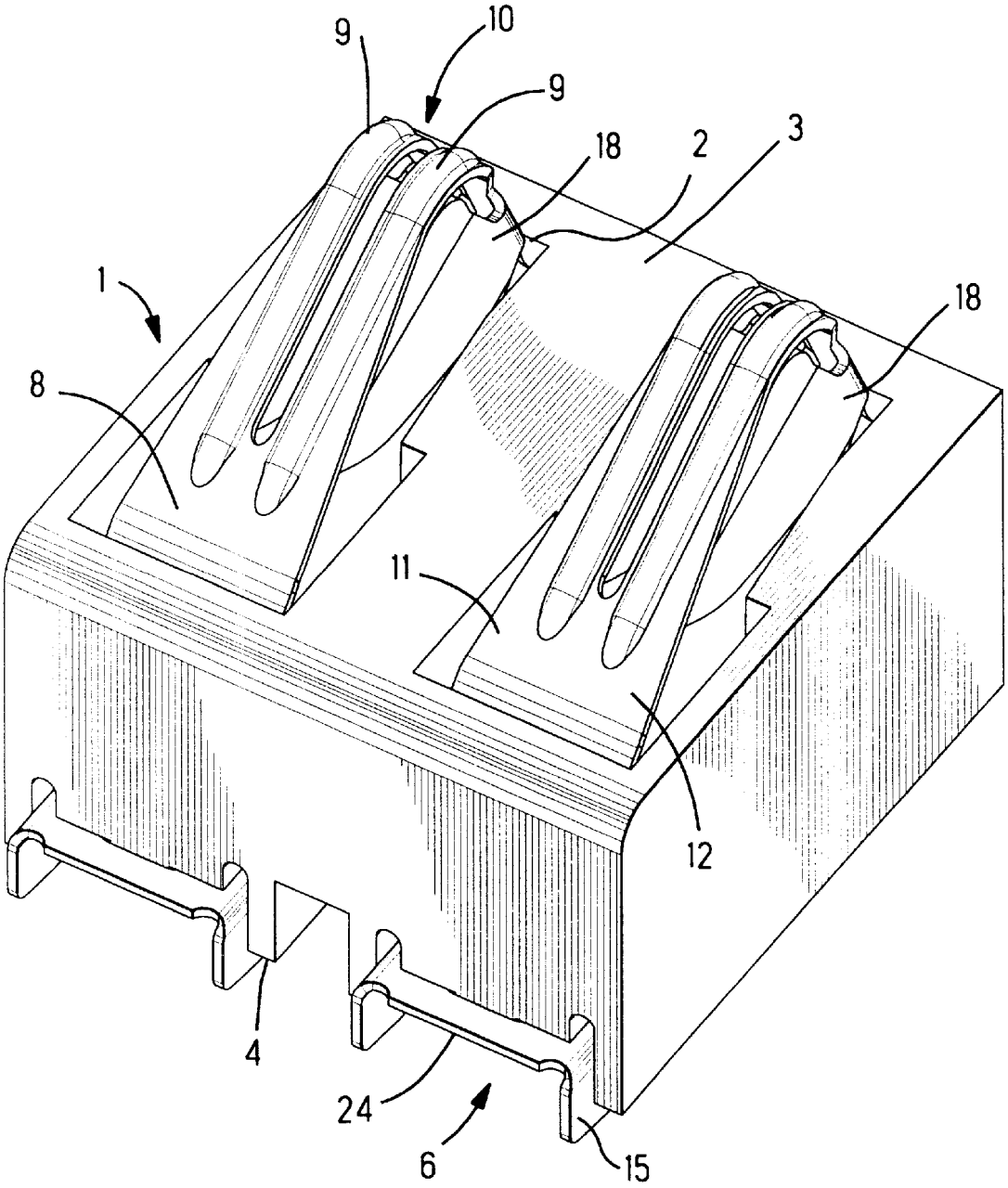
FIG. 1 shows an upper perspective view of a connector according to the present invention for contacting contact faces of an electrical or electronic component.

FIG. 1 illustrates in perspective a connector for contacting of contact faces of an electrical or electronic component, in particular a rechargeable battery. The connector is used, for example, in a portable telephone where the rechargeable battery is inserted. The connector consists of an insulating contact-receiving housing 1 with two passages 2 which are arranged next to one another extend from a contacting side 3 to a connection side 4. A contact 5 is arranged in each passage 2. The contact 5 is produced from sheet-metal by stamping and forming. The contact 5 has on the connection side 4, a connection region 6 for connection to a printed-circuit board and, on the contacting side 3, a contacting region 7 for contacting the contact face of the electrical or electronic component. A spring region 8 is arranged between the connection region 6 and the contacting region 7. The spring region 8 connects the connection region 6 resiliently to the contacting region 7. The passage 2 of the contact-receiving housing 1 receives the largest part of the spring region 8. In this case, the spring region 8 is guided by side walls of the contact-receiving housing 1 and is thereby protected against excessive lateral movements.

The contact element 5 has, in the contacting region 7, two convexities 9 located at a distance from one another. In the exemplary embodiment of FIGS. 1 to 4, the contacting region 7 and part of the spring region 8 of the contact element 5 have a gap 10 between the convexities 9. The gap 10 runs in the longitudinal direction of the contact element 5 and divides the latter into two regions 11, 12. The convexities 9 extend over a large area of the spring region 8 in the longitudinal direction of the contact element 5 and, in some regions, have different radii running perpendicularly to one another. This design of the convexities 9 ensures that the contact element 5, which has high flexibility, acquires greater rigidity in the longitudinal direction and allows good contacting of the contact faces of an electrical or electronic component, in particular a rechargeable battery, to be established. When the contact element 5 is pressed onto the contact face, the contacting region 7 deflect and gradually build up the necessary contact pressure.

As a result of the angled arrangement of the contacting region 7 in the contact-receiving housing 1 and by virtue of the elongate design of the convexities 9, the contact element 5 slides over the contact face of the rechargeable battery when the latter is being inserted and removed. By means of this sliding movement, the contact faces are wiped and freed of possible impurities. Due to high flexibility and because of the long spring travel of the contacting region, dimensional tolerances, which are unavoidable in the production of the contact faces of the batteries, are also compensated for sufficient contact is thus ensured, even when the rechargeable battery is repeatedly fitted and removed.

Figure 2:
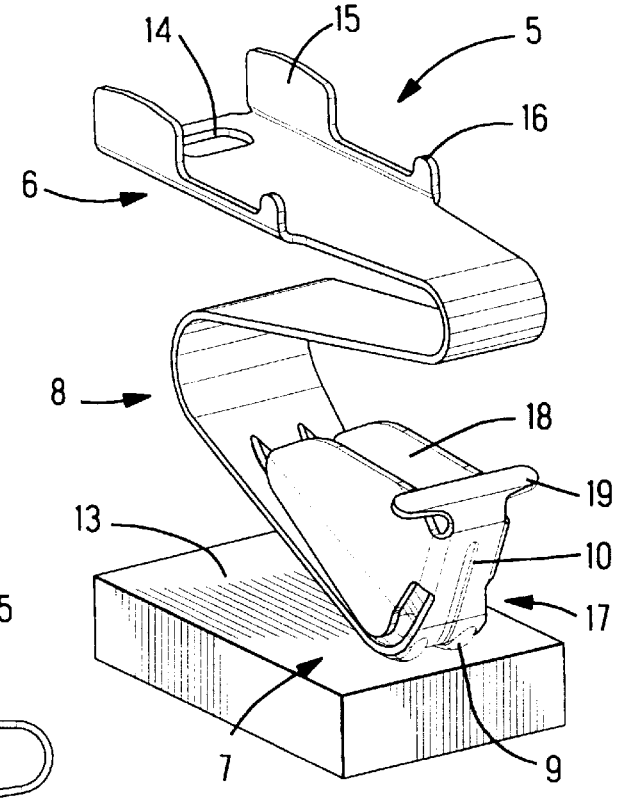
FIG. 2 shows a perspective view of the contact of the connector of FIG. 1.

FIG. 2 illustrates the contact 5 from the arrangement of FIG. 1, with the contact-receiving housing 1 removed for clarity. The contact 5 consists of a connection region 6, a spring region 8 and a contacting region 7. The convexities 9 of the contacting region 7 engage a contact face 13. The contact face 13, which is illustrated diagrammatically in FIGS. 2 to 4, is intended, here, to constitute one of the contact faces of a rechargeable battery.

Figure 3:
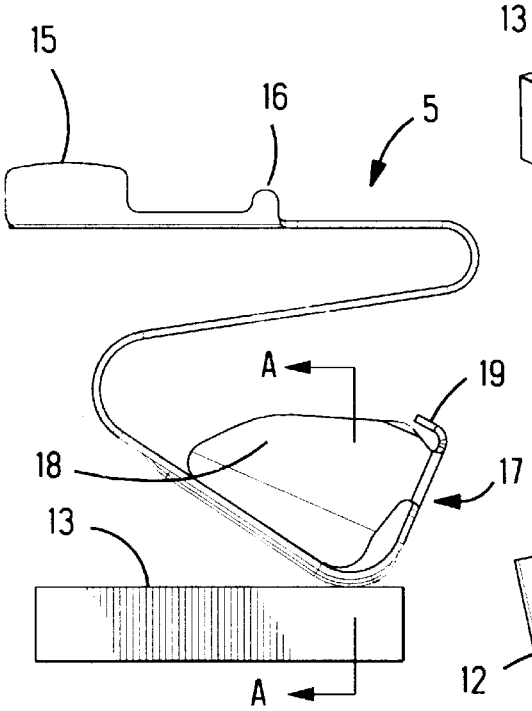
FIG. 3 shows a side view of the contact of FIG. 2.

FIGS. 2 and 3 show the contact 5 in a contacting position again without the receiving housing 1. It can also been seen in FIG. 2 that the connection region 6 has an orifice 14, in which a matching projecting region 24 (FIG. 5) of the contact-receiving housing 1 is received. As is evident, further, from FIGS. 2 and 3, that the connection region 6 also has two larger plate parts 15 bent away laterally and two smaller plate parts 16 bent away therefrom. The larger plate parts 15 serve for connecting the connection region 6 to a printed-circuit board (not illustrated here) and the smaller plate parts 16 serve for fastening the connection region 6 in the contact-receiving housing 1. The smaller plate parts 16 ensure, together with the orifice 14, a defined three-point fastening of the contact 5 in the contact-receiving housing 1. The contact 5 has, adjacent to the contacting region 7, a protective region 17. The protective region 17 consists of two protective plates 18 bent away laterally and of a transverse strip 19 arranged at the end of the contact 5. The protective plates 18 protect the contact 5 against damage and the transverse strip 19 cooperates with a stop of the contact-receiving housing 1 for the purpose of limiting the spring travel of the contacting region 7.

Figure 4:
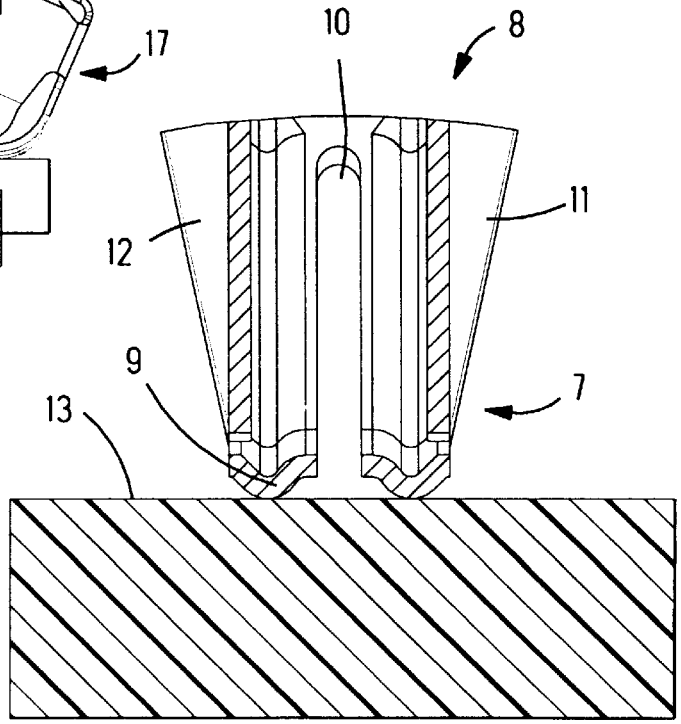
FIG. 4 shows a sectional view taken along line A—A of FIG. 3.
Figure 4A:
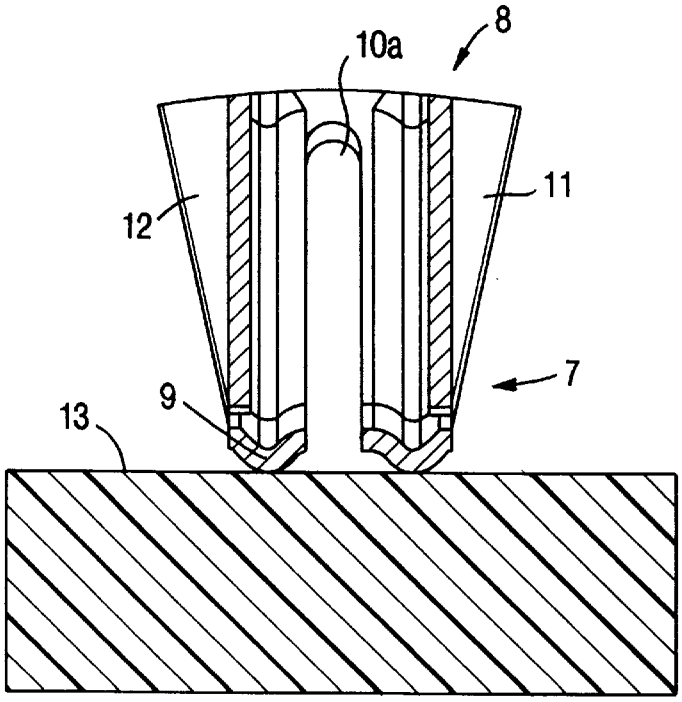
FIG. 4*a* shows a sectional view corresponding to FIG. 4 of an alternative contact construction.

It is clear from FIG. 4 how the convexities 9 touch the contact face 13 of an electrical or an electronic component, in particular a rechargeable battery. The gap 10 between the part regions 11, 12 of the contacting region 7 can also be seen in the section of FIG. 4. It is also evident from FIG. 4 how the transition from the contacting region 7 to the spring region 8 is made by widening of the regions 11, 12. The widening of the contact 5 makes it possible to achieve any desired spring force, depending on the width of the spring region 8. The removal of material in the region of the gap 10 makes it possible, quite apart from the weight saving, to influence the behavior of the part regions 11, 12 of the contacting region 7 to compensate for vibrations. By the gap 10 being formed between the regions 11, 12, the convexities 9 can act relatively independently of one another. This ensures that, for example in the case of vibration acting laterally on the arrangement for resilient contacting, at least one convexity 9 is certain to remain in contact with the contact face 13. FIG. 4 illustrates the gap 10 in the middle between two part regions 11, 12. It may also be envisioned, however, to arrange gap 10*a* eccentrically, so that two part regions 11, 12 are of different widths so that different forces are obtained at the contacting region 7 as shown in FIG 4*a*. The differences in mass ensure that the part regions 11, 12 act in a different way. The difference in mass results in each region 11, 12 having its own resonant frequency. This further reduces the probability that the contact between the convexities 9 and the contact face 13 will be broken simultaneously at two contact points. An eccentrically split contacting region 7 increases contacting reliability, distributes the contact forces over two part regions 11, 12 and increases the flexibility of the contacting region 7.

Figure 5:
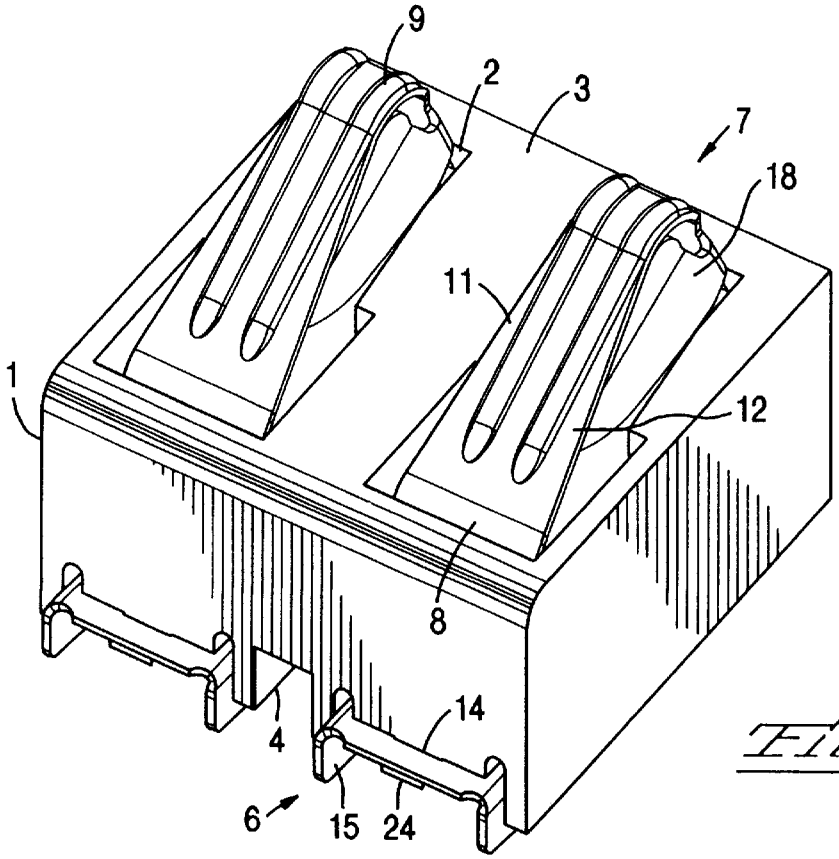
FIG. 5 shows a second exemplary embodiment of the present invention.

FIG. 5 illustrates a second embodiment of the connector. In contrast to the contacting region 7 of FIG. 1, the contacting region 7 of FIG. 5 has no through gap 10. A projecting region 24 can be seen on the connection side 4 of the contact-receiving housing 1, the said region cooperating with the orifice 14 of the connection region 6 of the contact 5. Even when the contacting region 7 has no through gap between the two convexities 9, the contacting region 7 still has some flexibility which increases contacting reliability.

Figure 6:
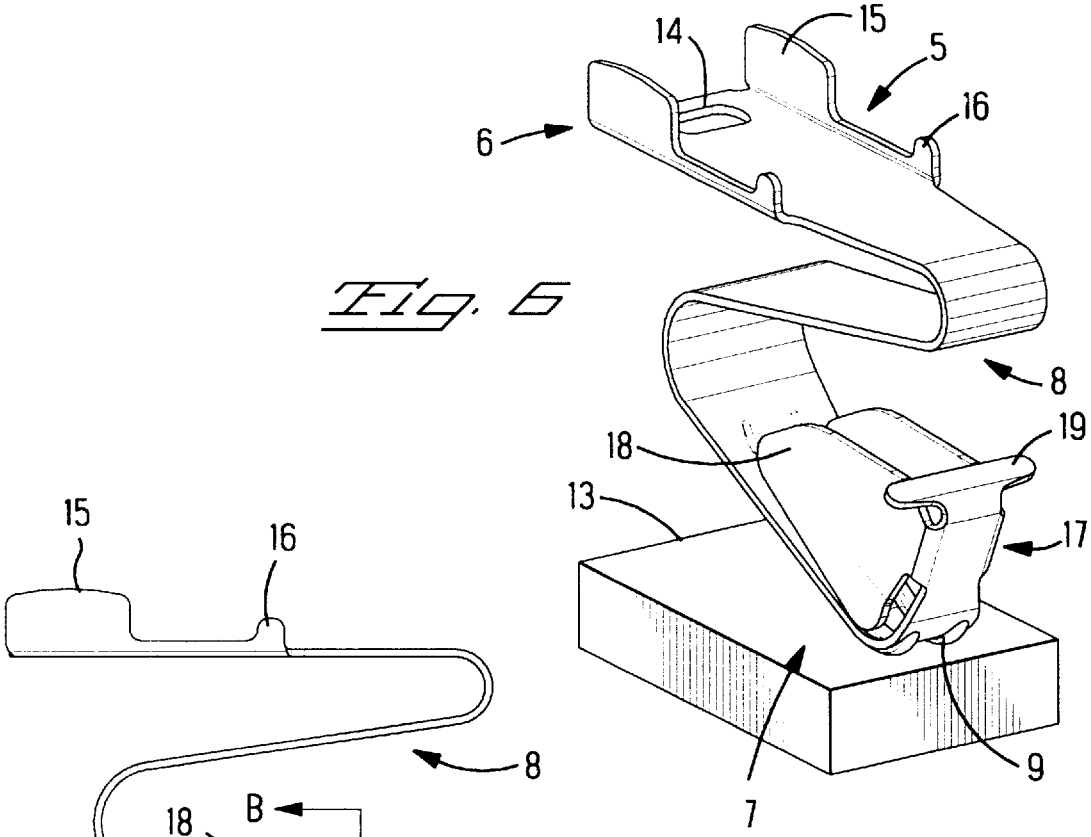
FIG. 6 shows a perspective illustration of the contact of the connector of FIG. 5.
Figure 7:
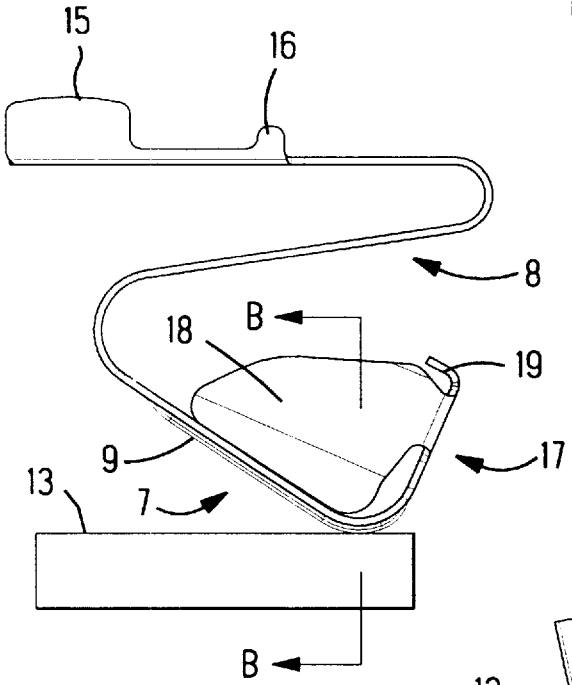
FIG. 7 shows a side view of the contact of FIG. 6.
Figure 8:
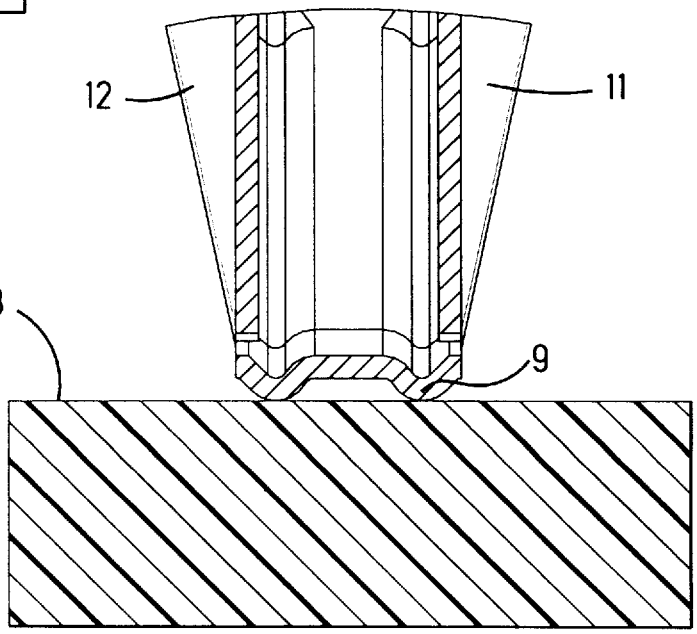
FIG. 8 shows a sectional view taken along line B—B FIG. 7.

FIGS. 6, 7 and 8 show the second exemplary embodiment of the contact element 5 of FIG. 5 once again, in the same way as in FIGS. 2, 3 and 4, but without the contact-receiving housing 1.

Figure 9:
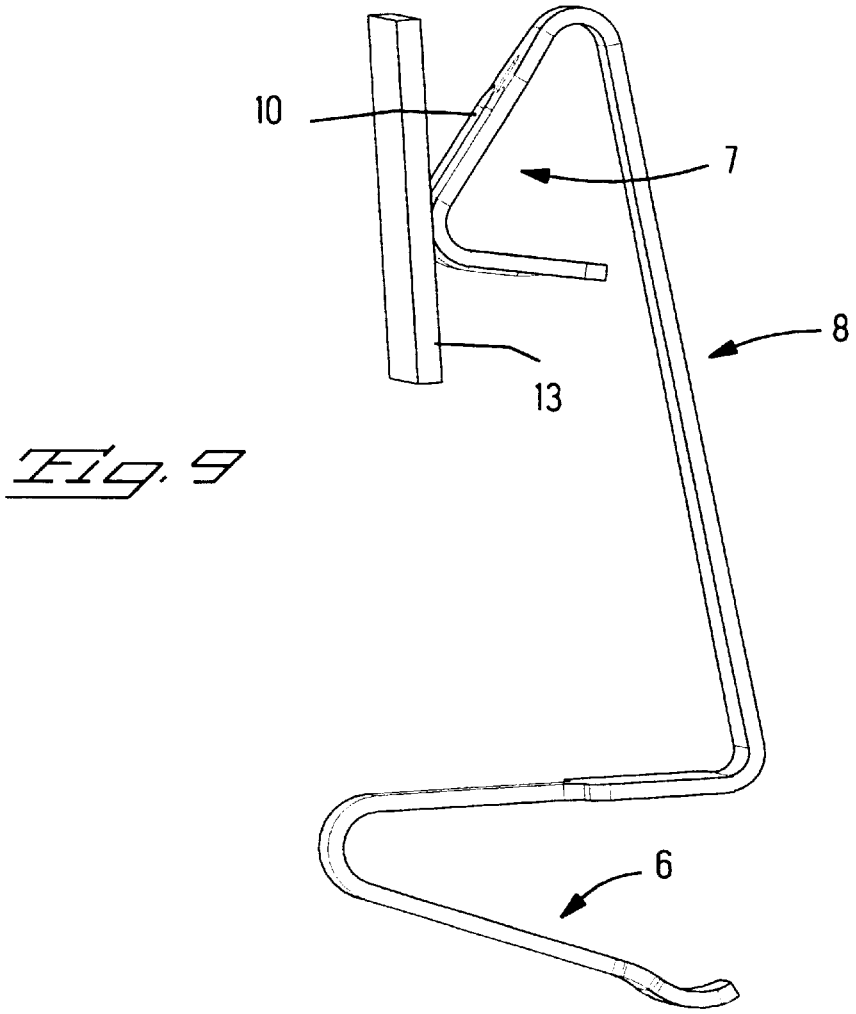
FIG. 9 shows a perspective illustration of another contact element according to the present invention.

FIG. 9 illustrates a third exemplary embodiment of a contact 5. In FIG. 9, the contact element 5 has a connection region 6 for connection to a printed-circuit board, a contacting region 7 for contacting the contact face 13, and a spring region 8 which connects the connection region 6 resiliently to the contacting region 7. In order to achieve higher flexibility for the contact element 5, the latter is bent at three points in the longitudinal direction.

Figure 10:
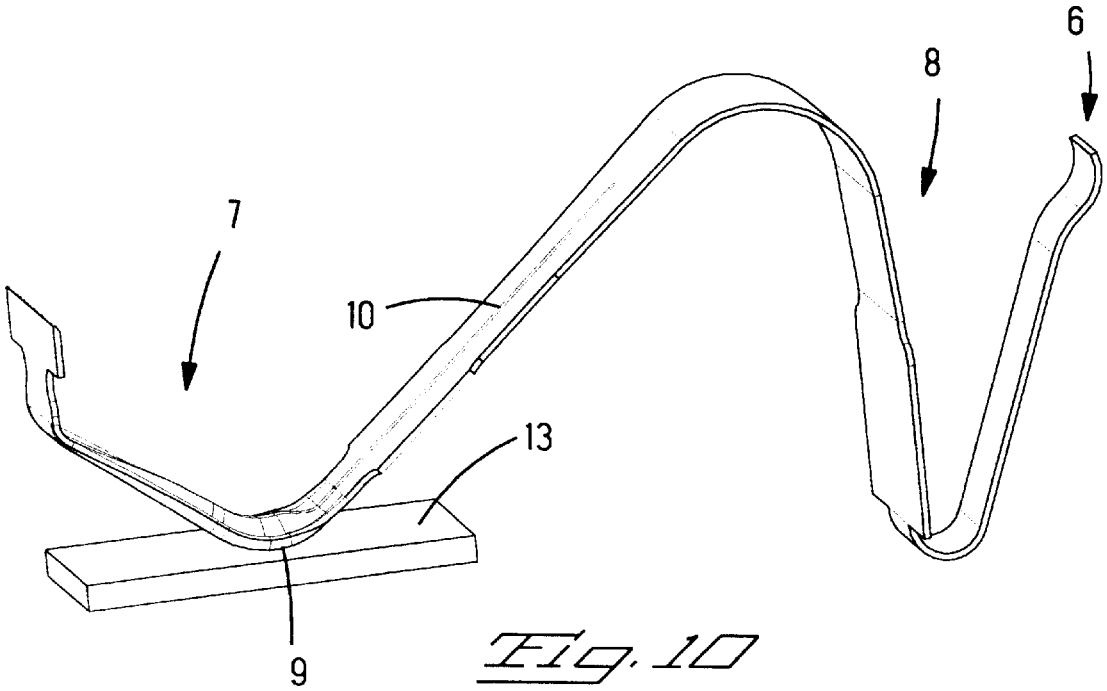
FIG. 10 shows a perspective illustration of yet another contact element according to the present invention.

FIG. 10 illustrates in perspective a fourth exemplary embodiment of a contact 5. In FIG. 10, it is seen that the contacting region 7 has a relatively elongated gap 10 along the longitudinal direction. This is intended to provide a different flexibility, depending on the spring effect requirement of the contact 5. The contacts 5 of FIG. 9 and FIG. 10 are designed differently, in order to show that a connector for contacting contact faces of the rechargeable battery can be achieved, even when the installation conditions in the electronic or electrical appliance are different.

Figure 11:
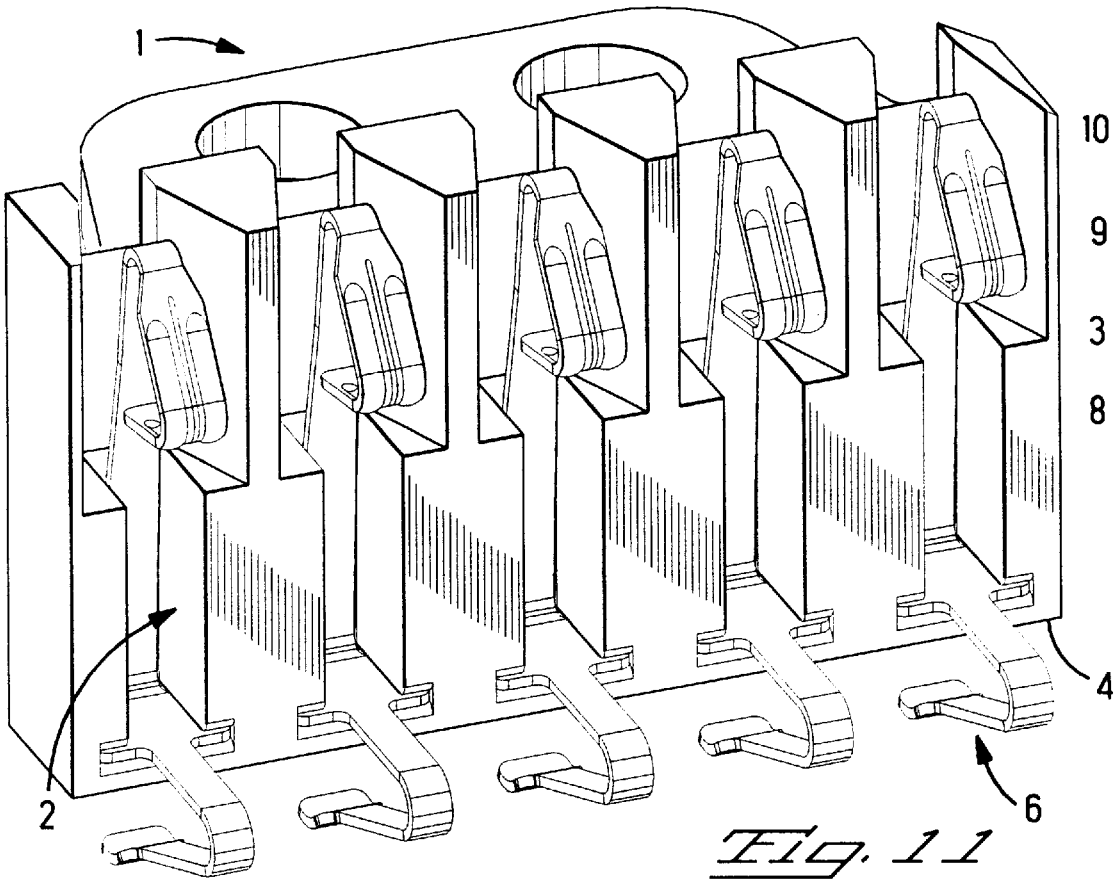
FIG. 11 shows a perspective illustration of still yet another connector according to the present invention which has a multiplicity of the contact elements of FIG. 9.
Figure 12:
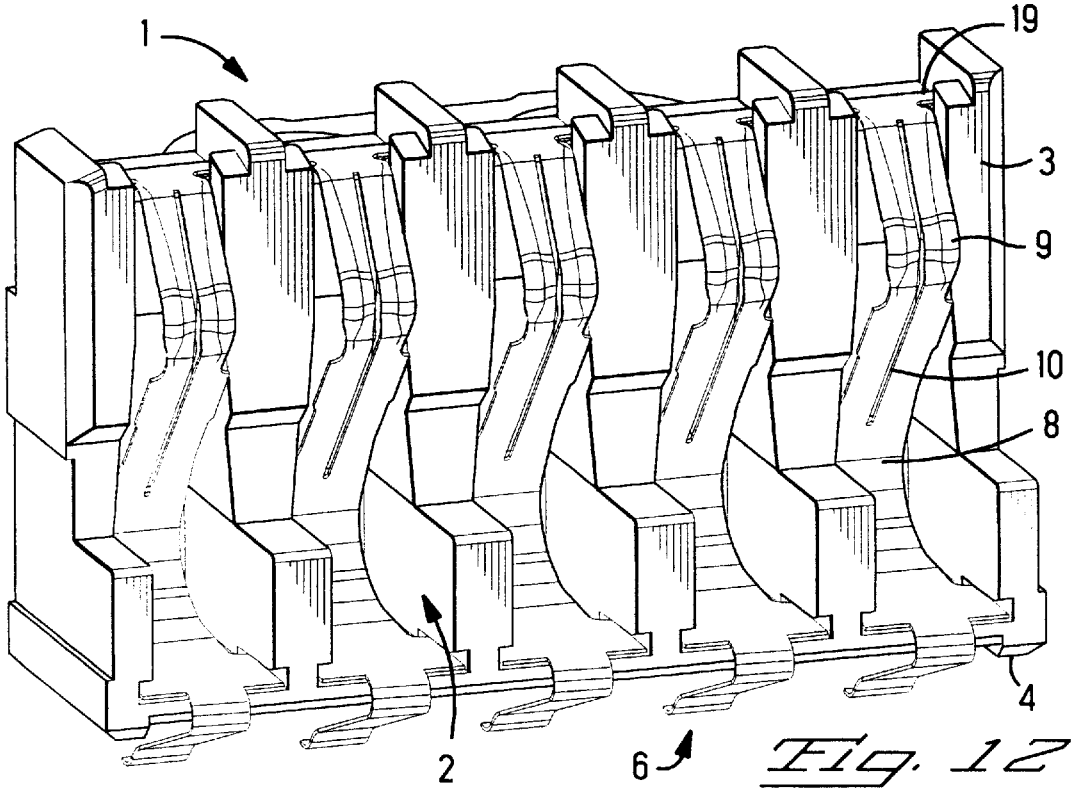
FIG. 12 shows a perspective illustration of yet still another connector according to the present invention having a multiplicity of contacts of FIG. 10.

The contact-receiving housings 1 which receive the contacts 5 of FIG. 9 and FIG. 10 are illustrated in FIGS. 11 and 12. Particularly the fastening of the contact 5 in these contact-receiving housings 1 is solved in a different way. Thus, it may be envisaged, for example, that the contact 5 is fastened in the plastic of the contact receiving housing 1 by stitching.

We claim:

1. A connector for contacting a contact face of a battery, comprising an insulating contact-receiving housing with at least one passage, a contact positioned in the passage that has at least one contacting region which serves for contacting the contact face of the battery, at least one connection region which serves for connection to a printed-circuit board, and a spring region having contacting surface and which connects the connection region resiliently to the contacting region, characterized in that the contacting region has at least two convexities that are arranged to run adjacently in a longitudinal direction of the contact along the contacting surface of the spring region with a closed perimeter gap formed therebetween.

2. The connector of claim 1, wherein the gap is formed relative a center line of the contact, such that the contact is divided into two regions of different width.

3. The connector according to claim 1, wherein the convexities extend from the contacting region over a substantial part of the spring region.

4. The connector according to claim 1, wherein the spring region is designed to be comparatively wider in the region adjoining the connection region than in the region adjoining the contacting region.

5. The connector according to claim 1, wherein the contact element has, adjacent to the contacting region, a protective region so that the contact is protected against damage and overloading.

6. The connector according to claim 1, wherein the spring region has at least two bends oriented transversely to the longitudinal direction.

7. The connector according to claim 1, wherein the contact element is arranged in the passage so as to be guided when deflected by side walls of the contact-receiving housing.

* * * * *